US009487961B2

(12) United States Patent
Grzondziel et al.

(10) Patent No.: US 9,487,961 B2
(45) Date of Patent: Nov. 8, 2016

(54) CONNECTING DEVICE FOR FORMWORK BOARDS

(71) Applicant: Hünnebeck GMBH, Ratingen (DE)

(72) Inventors: Georg Grzondziel, Oberhausen (DE); Mike Berwig, Mönchengladbach (DE); Volker Klehr, Viersen (DE)

(73) Assignee: Hunnebeck GMBH (DE)

( * ) Notice: Subject to any disclaimer, the term of this patent is extended or adjusted under 35 U.S.C. 154(b) by 0 days.

(21) Appl. No.: 14/648,004

(22) PCT Filed: Jan. 7, 2014

(86) PCT No.: PCT/EP2014/050119

§ 371 (c)(1),
(2) Date: May 28, 2015

(87) PCT Pub. No.: WO2014/108383

PCT Pub. Date: Jul. 17, 2014

(65) Prior Publication Data

US 2015/0308131 A1 Oct. 29, 2015

(30) Foreign Application Priority Data

Jan. 8, 2013 (DE) ..... 10 2013 200 147

(51) Int. Cl.
*E04G 7/22* (2006.01)
*E04G 17/04* (2006.01)

(52) U.S. Cl.
CPC ..... *E04G 7/22* (2013.01); *E04G 17/04* (2013.01); *E04G 17/045* (2013.01)

(58) Field of Classification Search
CPC . E04G 17/045; E04G 17/047; E04G 17/001; E04G 17/02; F16B 2/10; F16B 2/14; Y10T 403/7064; Y10T 403/7066; Y10T 403/7071
See application file for complete search history.

(56) References Cited

U.S. PATENT DOCUMENTS 4,529,163 A * 7/1985 Dingler ..... E04G 17/045 249/192
2006/0208152 A1* 9/2006 McCracken ..... E04G 17/045 249/192

FOREIGN PATENT DOCUMENTS

AT 396381 B 8/1993
AT 407412 3/2001

(Continued)

OTHER PUBLICATIONS

PCT International Search Report and Written Opinion issued by the ISA/EP on Jul. 14, 2015 in connection with International Application No. PCT/EP2014/050119.

(Continued)

*Primary Examiner* — Daniel P Stodola
*Assistant Examiner* — Jonathan Masinick
(74) *Attorney, Agent, or Firm* — Barnes & Thornburg LLP

(57) ABSTRACT

The invention relates to a connecting device for formwork boards having a formwork lining and elements supporting the formwork lining for producing concrete structures, wherein the connecting device comprises two claws and a clamping means, particularly a wedge or a clamping screw, in order to move the two claws towards one another for connection of two formwork boards, in such a manner that the supporting elements of two formwork boards are held in the desired position. The connecting device is characterized by a pivotable claw, which is formed such that the pivotable claw can be pivoted between a starting position and a final position, particularly about a shaft of the connecting device. This permits particularly simple assembly of the formwork boards to form a formwork and/or disassembly of a formwork.

17 Claims, 2 Drawing Sheets

(56) References Cited

FOREIGN PATENT DOCUMENTS

Figure 1:
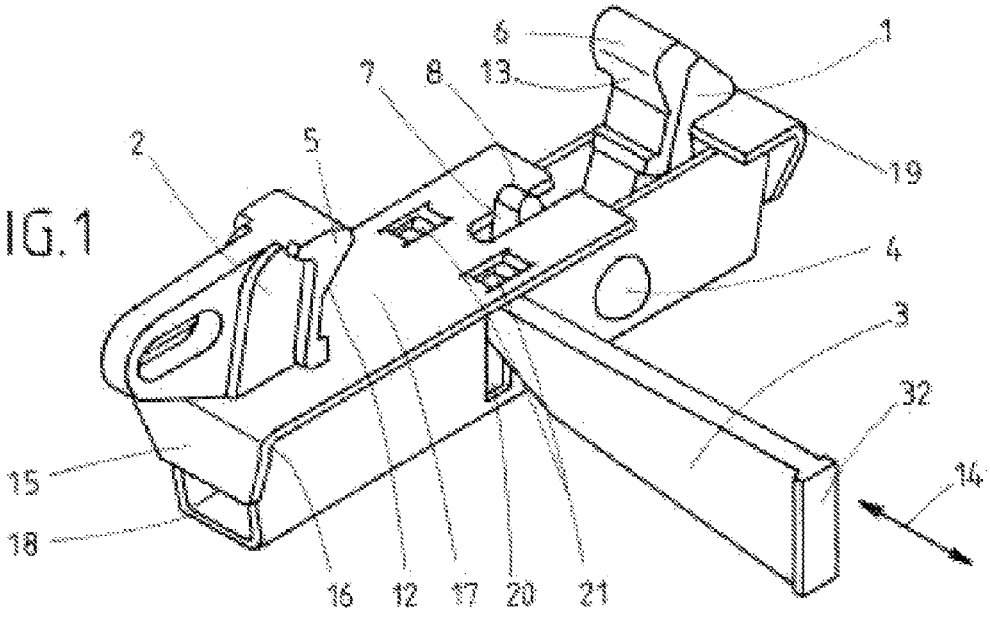

| | | | |
|---|---|---|---|
| BE | 1012700 | | 2/2001 |
| DE | 8009687 | | 7/1980 |
| DE | 10028556 | C1 | 9/2001 |
| DE | 10160482 | | 10/2003 |
| DE | 10330462 | | 1/2005 |
| EP | 0304950 | A2 | 3/1989 |
| EP | 0953778 | | 11/1999 |
| ES | 2292272 | | 3/2008 |
| IT | 1260794 | | 4/1996 |
| WO | 03050445 | | 6/2003 |
| WO | 2005005750 | | 1/2005 |
| WO | WO 2012021505 | * | 9/2012 |

OTHER PUBLICATIONS

English language translation of PCT International Search Report and Written Opinion issued by the ISA/EP on Jul. 14, 2015 in connection with International Application No. PCT/EP2014/050119.

PCT International Search Report and Written Opinion completed by the ISA/EP on Apr. 30, 2014 and issued in connection with PCT/EP2014/050119.

* cited by examiner

CONNECTING DEVICE FOR FORMWORK BOARDS

This application is a U.S. national counterpart application of international application serial No. PCT/EP2014/050119 filed Jan. 7, 2014, which claims the benefit of German Patent Application No. 102013200147.9 filed Jan. 8, 2013.

The invention relates to a connecting device for formwork panels for building concrete structures. The invention further relates to a system comprising the connecting device and two formwork panels.

A formwork panel comprises a formwork facing on the front and elements supporting the formwork facing on the back, such as longitudinal beams, crossbars and frames. As a rule, supporting elements consist of metal. The formwork facing, as a rule, consists of wood, a derived timber product and/or plastic.

In order to build walls, ceilings or the like, formworks are formed from a plurality of formwork panels. A formwork within the sense of the present invention is used in formwork engineering for concreting reinforced concrete structures. Matched to the dimensions of a wall, ceiling or the like to be built, formwork panels are disposed next to each other or one above the other and connected to each other using one or more connecting devices.

A larger overall surface area is thus obtained as compared with the formwork surface area of one formwork panel. For example, two formwork panels placed one next to the other are connected to each other by one or more connecting devices in order to fix the position and arrangement of the formwork panels. Such a connecting device is known from document DE 103 30 462 A1 as a "turnbuckle device". It comprises two claws that can be displaced relative to each other. A wedge or the like is provided in order to displace the two claws, for connecting two formwork panels, in such a way that they keep these supporting elements of two formwork panels in their desired position.

The two sides of a wall to be concreted are delimited by formworks facing each other. The front, i.e. the formwork facing, of each formwork in that case adjoins the concrete. Formworks facing each other are generally held by a plurality of anchoring systems. The anchoring rods of an anchoring system are pushed through openings in the formworks and attached at their ends to the elements supporting the respective formwork facing in such a way that at least the tensile force acting upon the anchoring rods during concreting is absorbed.

Usually, the two ends of the anchoring rods comprise threaded portions onto which nuts are screwed as anchor fixing members. The middle region of an anchor rod, to which concrete can adjoin during concreting, basically comprises either a smooth surface or is enveloped by at least a sleeve having a smooth surface.

Spacers can be introduced between the formwork facings into the volume of the wall to be concreted, which are able to absorb compression forces arising during concreting, whereby it is ensured that these compression forces do not affect, i.e. reduce, the wall thickness in an undesirable manner. Alternatively or additionally, the locking devices can be attached to the formwork panels so that they are also able to absorb compression forces.

Document EP0953778A1 discloses a locking assembly for concrete formworks with a nut device for rapid assembly.

Document DE8009687U1 describes a device for detachably connecting a beam of a formwork element with a steel bar or the like, which extends substantially horizontally and transversely to the beam, with two interconnected pairs of retaining legs.

Document DE10160482A1 shows a clamp-coupling device particularly for scaffolding tubes, which is formed from saddle halves to whose ends clamp halves are respectively pivotably attached via the hinge mountings.

Document DE10028556C1 discloses a tension clamp for connecting two adjacent formwork elements of a concrete formwork with two clamping jaws, one of which is pivotably mounted on the other.

Similar devices are described also in the documents BE1012700A3, ES2292272A1 and AT407412B.

The above-mentioned features, which are known from the prior art, can be combined, individually or in any combination, with any one of the subject matters of the invention described below.

It is an object of the invention to provide a connecting device that simplifies the assembly and/or dismantling of formworks.

In order to achieve the object, a connecting device comprises the features of claim 1. The dependent claims relate to advantageous embodiments.

In order to achieve the object, a connecting device for formwork panels with a formwork facing and elements supporting the formwork facing for building concrete structures is provided, wherein the connecting device comprises two claws and a clamping means, in particular a wedge or a clamping screw, in order to move the two claws relative to one another in such a way, for connecting two formwork panels, that the supporting elements of two formwork panels are held in their desired position.

The connecting device according to the invention provides a pivotable claw configured in such a way that the claw can be pivoted back and forth between an initial position and a final position, particularly about an axis of the connecting device.

In the final position, the connecting device in the assembled state ensures that the supporting elements of two formwork panels are held in their desired position. The one claw then rests against a supporting element of the formwork panel and the other claw on a supporting element of the other formwork panel disposed above or next to it. In principle, these supporting elements are frame elements of a formwork panel.

The connecting device according to the invention with a pivotable claw enables a particularly simple assembly of the formwork panels to form a formwork and/or dismantling of a formwork. Moreover, by providing a pivotable claw, a particularly compact connecting device can be provided and/or a particularly large opening angle between the claws can be made possible.

Pivoting about a fixed axis of the connecting device reduces the degree of freedom and thus additionally facilitates assembly and dismantling of the connecting device for the user. Assembly and dismantling of the connecting device means the assembly of the formwork panels to form a formwork using the connecting device or the removal of the connecting device from a formwork.

Alternatively or additionally to the above-described features of a connecting device according to the invention, a connecting device with an intermediate position between an initial position and a final position is provided, which can be adopted by placement against the supporting elements.

The connecting device according to the invention with an intermediate position and the thus reduced pivoting distance into the final position thus makes a particularly rapid and simple assembly and dismantling of the connecting device possible for the user. Moreover, a smaller or shortened clamping means can be used for the connecting device because of the invention.

In one embodiment of the invention, an actuating means for pivoting the pivotable claw into the intermediate position is provided. The actuating means according to the invention is configured, in particular, as a projection on the pivotable claw which can be actuated by placing the connecting device on the supporting elements. By providing an actuating means or a projection, it is possible to accomplish in a particularly simple way that the connecting device can be brought into the intermediate position without any additional working step when placing it against the supporting elements.

In one embodiment of the invention, the projection of the pivotable claw is configured to be triangular, preferably with a leg angle of 30° to 40°, preferably 35°, and/or has a rounded tip, preferably with a radius of 3 mm to 6 mm, preferably 4 mm to 5 mm, more preferably 4.5 mm.

Tip of the contour means the region of the outer contour of the projection which first comes into contact with the supporting elements when placing the connecting device in the initial position against the supporting elements.

The triangular shape of the projection and the rounded tip of the projection cause an advantageous transmission of forces of the supporting elements via the tip of the projection onto the claw, whereby a particularly high level of stability, wear resistance and reliable function of pivoting inwards can be obtained.

In one embodiment of the invention, the axis of the connecting device is disposed between the actuating means and a tab of the pivotable claw which enters a groove of a supporting element in the final position of the connecting device, for example in the manner known from the German patent application with the file number 102012214396.3. Using the arrangement according to the invention, the connecting device can be assembled particularly rapidly and the clamping means can be dimensioned to be particularly short.

In one embodiment of the invention, the actuating means is disposed in such a way that the moment arm is shorter than the load arm.

Moment arm means the distance from the axis to the line of force of the force that is applied by a supporting element to the actuating means in the initial position during placement against the connecting device. Load arm means the distance from the axis to the tab of the pivotable claw.

Because the moment arm is shorter than the load arm, a short movement of the actuating means during pivoting from the initial position into the intermediate position can cause a large movement of the tab of the pivotable claw. Since the pivoting distance of the pivotable claw owed to the placement of the connecting device against the supporting elements need not be generated by the clamping means, the clamping means can be dimensioned to be smaller and shorter.

In one embodiment of the invention, a returning means is provided which presses a claw, in particular the pivotable claw, in the direction of the initial position. Such a returning means may be, in particular, a biased spring or torsion spring, which extends, for example, around the axis of the connecting device.

Troublesome movements of the claws during handling and placement can thus be avoided. Furthermore, the claws strive towards the initial position, i.e. an opened claw position, when placing the connecting device against the supporting elements and removing it therefrom. Handling, assembly and dismantling can thus be made particularly easy for the user.

In one embodiment of the invention, the connecting device is configured in such a way that a translational movement of the clamping means can cause the pivotable claw to pivot, particularly in the direction of the final position and/or the initial position. The direction of movement of the clamping means is preferably orientated parallel to the grooves of the supporting elements or parallel to the axis of the connecting device.

The translational direction of movement of the clamping means parallel to the grooves in the supporting elements makes it possible to provide a connecting device with especially small space requirements. The advantages of the conversion of a translational movement into a pivoting movement by means of a wedge as a clamping means and a pivotable claw include the possibility of using a hammer or a similar tool for inserting the wedge and moving the connecting device into the final position and a particularly large self-locking action in the final position.

Alternatively, a worm gear, for example, could be used, in which a translational movement of a screw-shaped worm drives a rotationally movable gear that could be firmly connected to the pivotable claw. The disadvantages of this embodiment, however, would be the increased production expenditure, the smaller self-locking action in the final position and the increased wear when using a hammer.

In one embodiment of the invention, the pivotable claw has a lever arm that can be pivoted by inserting the clamping means for moving the claw into the final position, wherein the axis of the connecting device is preferably disposed between the lever arm and the tab of the pivotable claw. By means of a pivotable claw with a lever arm and a suspension of the axis between the tab and the lever arm, a connecting device that requires a smaller actuating force to bring the connecting device into the final position can be provided with particularly little production expenditure.

In one embodiment of the invention, the lever arm is configured in such a way that the moment arm of the lever arm, relative to the interface of the lever arm with the clamping means, is longer than the moment arm of the actuating element. This makes it possible that a force applied to the lever arm, compared with the application of the same force to the actuating element, is able to cause a larger contact force of the pivotable claw on the supporting elements. Thus, the user only has to apply a particularly small force in order to move the connecting device into the final position.

In one embodiment of the invention, the pivotable claw between the tab and the lever arm is configured in an L-shape, wherein the axis is preferably disposed in the direction-changing region of the L-shape. In the direction-changing region, the arms of an L-shape meet with different orientations. By configuring the pivotable claw in an L-shape with an arrangement of the axis in the direction-changing region, a particularly compact connecting device with a small pivoting radius and small pivot arc length can be provided.

In one embodiment of the invention, the direction-changing region of the L-shaped pivotable claw is rounded. By rounding off the direction-changing region, stress peaks in the final position of the connecting device can be reduced and thus, a connecting device with a particularly long life can be provided.

In one embodiment of the invention, a housing of the connecting device comprises a slide bearing for the clamping means, in particular the wedge. The slide bearing is disposed in such a way that, when inserting the clamping means into the connecting device, the clamping means is driven between the lever arm of the pivotable claw and the slide bearing of the housing. The friction between the clamping means and the housing during assembly, and thus the required actuating forces for the user, can be reduced by means of the slide bearing of the housing. A particularly simple embodiment of such a slide bearing can be realized by providing two support surfaces disposed in such a way that the interface of the clamping means with the lever arm is disposed centrally between the two support surfaces.

In one embodiment of the invention, the housing of the connecting device comprises a guide for a translational movement of the clamping means, in particular a wedge, preferably by means of two slits. Malfunctions, for example due to the clamping means slipping off the lever arm of the pivotable claw during assembly, can thus be avoided. By providing a guide for a translational movement of the clamping means during the insertion into the connecting device, a connecting device that functions particularly reliably can thus be provided. Such a guide can be implemented with a particularly low production expenditure by means of two slits in the housing.

In one embodiment of the invention, the housing is made from formed sheet metal parts, in particular with a top part for placement against the supporting elements and configuring a slide bearing for the clamping means, in particular a wedge, and a U-shaped profile for suspending the axis and inserting slits for guiding the clamping means. A connecting device can be provided with a particularly low production expenditure due to a housing that can be made from formed sheet metal parts.

In one embodiment of the invention, the clamping means, in particular a wedge, has at least two portions with different angles of gradient, with the first portion with the smallest angle of gradient preferably being disposed in such a way that the first portion of the clamping means, in the final position, is in engagement with the pivotable claw.

This embodiment of the invention is based on the insight that a small angle of gradient causes a small transmission ratio of the translational movement or advancing force of the clamping means, in particular the wedge, into pivoting or torque the pivotable claw, and a large angle of gradient, accordingly, a large transmission ratio.

Therefore, when assembling the connecting device on the supporting elements of two formwork panels, a portion with a large angle of gradient is to be provided first for delivering the claws, i.e. pivoting the claws into the vicinity of the final position. In order to pivot the claws in the final position, as opposed to the delivery, a large force is required for clamping with the supporting elements. A portion of the clamping means, in particular the wedge, with a low angle of gradient in this case ensures that a particularly small force from the user is capable of moving the pivotable claw into the final position.

In one embodiment of the invention, the first portion of the clamping means, in particular the wedge, has an angle of gradient of preferably greater than 2°, preferably greater than 4°, particularly preferably greater than 6°, and preferably less than 12°, preferably less than 10°, particularly preferably less than 8°. A second portion for delivering the pivotable claw has an angle of gradient of preferably greater than 15°, preferably greater than 20°, particularly preferably greater than 25°, and preferably less than 40°, preferably less than 35°, particularly preferably less than 30°, or preferably less than 60°, preferably less than 55° and particularly preferably less than 50°.

Because of the disclosed range of the angle of gradient of the first portion of the clamping means, in particular the wedge, a particularly large self-locking action of the connecting device in the final position can be achieved. Because of the disclosed range of the angle of gradient of the second portion, a particularly short clamping means can be provided.

In one embodiment of the invention, the clamping means, in particular the wedge, has a recess for locking the clamping means with a fixed orientation in the initial position, in particular a U-shaped recess. It is made possible by the recesses that the claws can be fixed in the initial position with a particularly large opening angle relative to one another, and that thus the connecting device can be placed on the supporting elements for assembly particularly simply and rapidly.

In one embodiment of the invention, the U-shaped recess is adapted to the end of the lever arm of the pivotable claw, particularly by providing a play and/or by beveling the side walls of the U-shaped recess. The lever arm of the pivotable claw can thus be made to pivot or insert itself into the recess particularly reliably.

In one embodiment of the invention, the clamping means, in particular the wedge, has on the end passed through the housing a bore for attaching a stop means, e.g. a bolt or rivet, and on the other end of the clamping means an expanded portion, in particular T-shaped. Due to the bore on the one end of the clamping means, the clamping means, by means of the stop means attached thereto, can be held in a loss-proof manner in the region of the connecting means extended through the housing, whereby a connecting device can be provided that functions particularly reliably.

Due to the T-shaped profile at the other end of the clamping means, in particular the wedge, dismantling is simplified because an impact surface for a hammer or a similar tool for moving the clamping means out of the connecting device is provided. Furthermore, the expanded portion brings about an increased stability when a hammer or a similar tool is used during assembly.

In one embodiment of the invention, the clamping means is a clamping screw. A clamping screw is a threaded component. By providing a clamping screw as a clamping means, a high clamping force of the connecting device can be achieved with a particularly small application of force.

In one embodiment of the invention, the connecting device is configured in such a way that the clamping screw can be screwed perpendicularly into the bottom of the U-shaped profile in order to pivot the pivotable claw into the final position, into the initial position or into the intermediate position. Due to the perpendicular orientation of the clamping screw relative to the housing of the connecting device, the user gains a particularly good access to the clamping screw in order to screw it in or out.

In one embodiment of the invention, one claw, preferably both claws, is configured in a fork shape in such a way that the two prongs of the fork are able to grasp around a crossbar. The crossbar is a U-shaped supporting element orientated perpendicularly to the abutting surface to the adjacent formwork panel to be connected. A fork-shaped claw enables the claw to rest against both webs or side walls of the crossbar and to thus be capable of absorbing particularly large forces. In addition, a fork-shaped claw can enable a particularly good guidance during placement against the supporting elements, and thus a simpler assembly.

In particular, the actuating means, preferably the projection, for pivoting the pivotable claw into the intermediate position is disposed between the two ends of the pivotable claw. Preferably, the one end is the tab and/or the other end is the lever arm. The connecting device is thus easier to actuate.

In particular, the actuating means, preferably the projection, for pivoting the pivotable claw into the intermediate position is disposed between the axis or pivoting axis of the pivotable claw and one end of the pivotable claw. Preferably, the end is the tab or the lever arm. The connecting device is thus easier to actuate.

In particular, the actuating means, preferably the projection, for pivoting the pivotable claw into the intermediate position extends inwards, preferably substantially orthogonally to the axis or pivoting axis of the pivotable claw and/or substantially orthogonally to the pivotable claw with the actuating means, which is not shown. Substantially orthogonal means an angle between 30° and 150°, preferably between 45° and 135°, particularly preferably between 60° and 120°, most particularly preferably between 80° and 100°. "Inwards" means a region, which, in the case of a bent or L-shaped pivotable claw, can be or is enclosed by connecting the two ends of the pivotable claw. The connecting device is thus easier to actuate.

According to another aspect of the invention, a system is provided, which comprises two formwork panels and a connection means according to claim 1, wherein the two formwork panels are held in their desired position by the connecting device. The assembly and dismantling of the formwork is simplified to a particular extent by the system according to the invention comprising two formwork panels and the connecting device according to the invention.

The present invention, in particular, comprises the configurations known from the German patent application 102012214396.3 for solving the technical problems mentioned in that patent application. We incorporate the content of the disclosure of that application into the present application. Therefore, the present invention is, in particular, additionally configured as follows:

In one embodiment, a system is provided for building walls consisting of concrete, with a formwork panel and a connecting device with which the formwork panel can be connected with another formwork panel disposed next thereto or above it, which system is configured in such a way that the connecting device is connected to the formwork panel, in particular mechanically connected or connectable so as to be detachable.

"Connected" in this context means that the connecting device can be connected to the formwork panel even if the connecting device is not used to connect the formwork panel to another formwork panel. Therefore, "connected" also includes the case where the connecting device is or can be connected to the formwork panel irrespective of the state of the assembly. Thus, this connection need not be disengaged for assembly or dismantling, i.e. for connecting the formwork panel to a formwork panel disposed next to it or above it, for example.

"Mechanically connected so as to be detachable" in this context correspondingly means that the connecting device can be detached from the formwork panel at least by means of tools. A mechanical connection is provided if the connecting device is connected to the formwork panel by positive connection and/or non-positive connection, wherein a substance-to-substance connection is not considered to be a mechanical connection in this context. Such a connecting device can be connected, within the sense of the invention, to the formwork panel.

Preferably, the connecting device is connected to the formwork panel in such a way that no tools are required for such a detaching process.

In one embodiment, the system is configured in such a way that the connecting device is attached to two supporting elements of the formwork panel, preferably in such a way that at least one component of the connecting device can be moved back and forth between the two supporting elements.

In one embodiment, the system is configured in such a way that a rod of the connecting device is attached to one or two supporting elements of the formwork panel.

In one embodiment, the system is configured in such a way that at least one other component of the connecting device is movably connected to the rod.

In one embodiment, the system is configured in such a way that the connecting device comprises a component having an elongated hole through which a rod of the connecting device passes.

In one embodiment, the system is configured in such a way that at least one component of the connecting device can be moved against a supporting element of the formwork panel in such a way that the at least one component is capable of introducing into the at least one supporting component the load which arises when the formwork panel is being connected or is connected to another formwork panel by means of the connecting device.

In one embodiment, the system is configured in such a way that the connecting device comprises a rod with a broadened region in such a way that the rod, but not the broadened region, can be pushed through a hole in a supporting element of the formwork panel.

In one embodiment, the system is configured in such a way that the broadened portion is wedge-shaped.

In one embodiment, a connecting device for the system is configured in such a way that the connecting device with a fastening device, in particular comprising a rod, which can be mechanically detachably connected to at least one supporting element of the formwork panel, and at least one further component with which two adjacent formwork panels can be connected for a concreting process.

In one embodiment, the connecting device is configured in such a way that the at least one further component can be pivoted about the rod and the pivoting movement can be fixed relative to the rod, preferably in two different positions.

In one embodiment, the connecting device provides a retaining means for retaining the at least one further component in a parking position, wherein the retaining means comprises, in particular, a spring and/or a magnet.

In one embodiment, the connecting device is configured in such a way that the connecting device comprises two claws that can be moved relative to one another, and a wedge by means of which the two claws can be moved towards each other.

In one embodiment, the connecting device is configured in such a way that the wedge comprises a hook-shaped end.

In one embodiment, the connecting device is configured in such a way that the rod of the connecting device is passed through an elongated hole of the one claw.

In one embodiment, the connecting device is configured in such a way that the rod comprises a portion whose cross section is adapted to the elongated hole in such a way that a pivoting movement of the at least one further component of the connecting device about the rod can be prevented thereby.

In one embodiment, the connecting device provides a wedge configured in such a way that it can be fixed in an oblique position in a rest position of an at least one further component of the connecting device.

In one embodiment, the intermediate position can be reached by manual actuation of the pivotable claw. By manually actuating the pivotable claw, it is possible, in particular, that the wedge falls into an intermediate position which facilitates driving it in further by means of a hammer.

In another embodiment, the above-described intermediate position is reached by pivoting the wedge away, in particular from its locking position, generally away from the formwork panel in the direction of the user, wherein the pivotable claw can be pivoted into the intermediate position, but the wedge still remains in the locking position.

Both of the above-mentioned embodiments facilitate to a particular extent the assembly during the connection of two formwork panels.

The invention is explained in more detail below with reference to figures. In the drawings:

FIG. 1: shows the connecting device in the initial position

Figure 2:
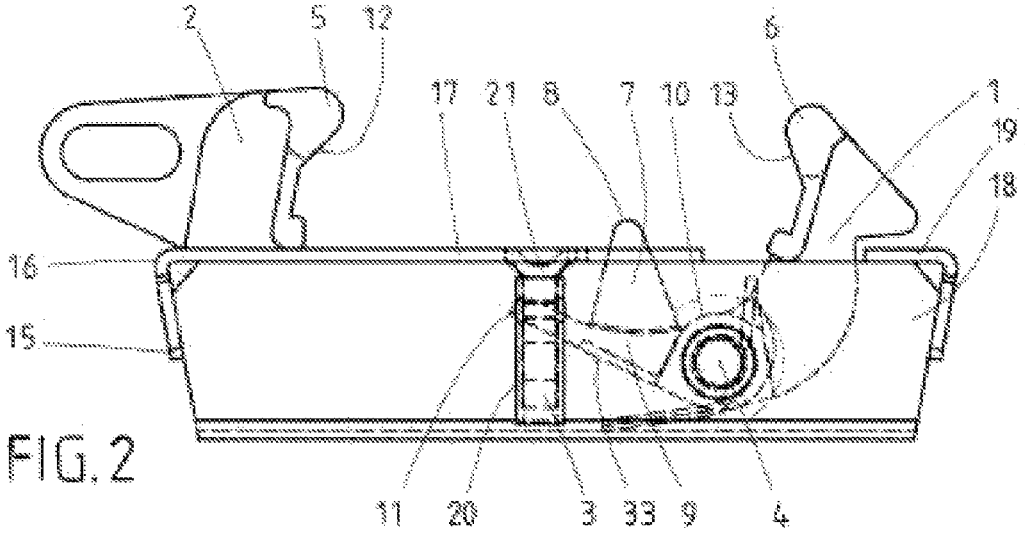

FIG. 2: shows a side view of the connecting device in the initial position

Figure 3:
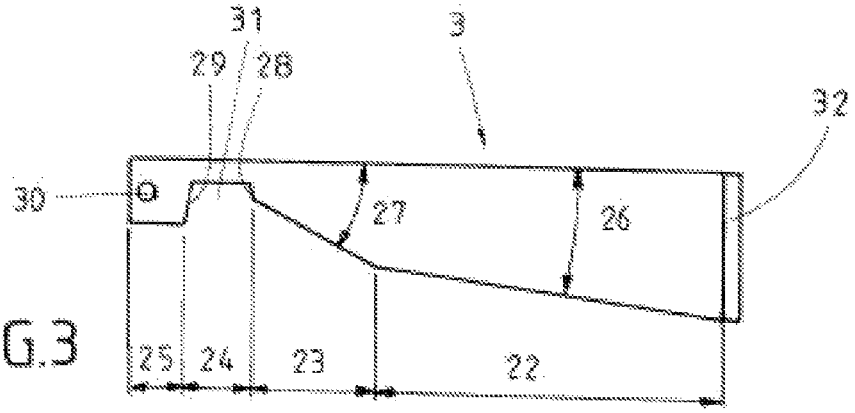

FIG. 3: shows a side view of the clamping means configured as a wedge

Figure 4:
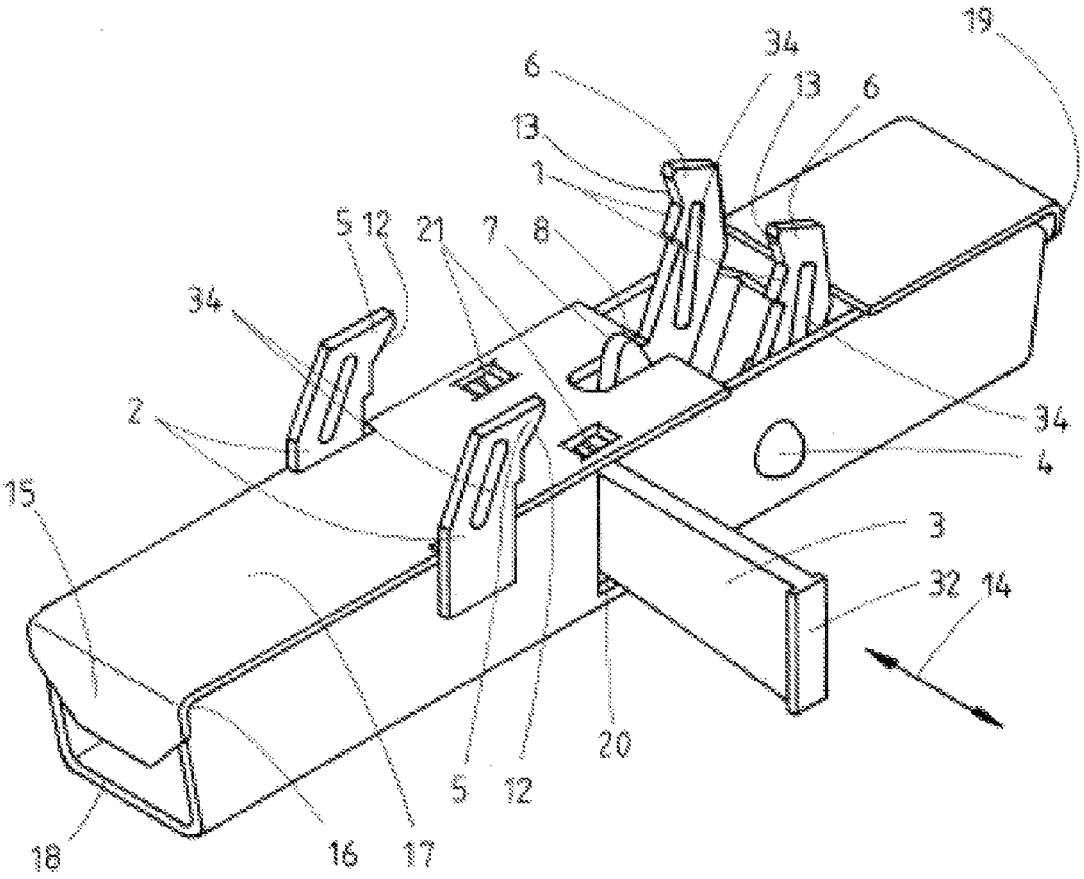

FIG. 4: shows another exemplary embodiment of a connecting device in the initial position with fork-shaped claws The features specified within the context of the following exemplary embodiments can be combined individually or in any combination with the subject matters of the claims.

FIG. 1 shows an exemplary embodiment of the connecting device according to the invention for connecting two formwork panels for building concrete structures. The connecting device has a claw 2 that is stationary or firmly connected to the housing 15 and a pivotable claw 1 and a wedge 3. A rivet 4 forms the axis of the connecting device about which the pivotable claw 1 can be pivoted from the initial position into the final position.

In the final position, the pivotable claw 1 has been pivoted in such a way that the tabs 5, 6 reach into one groove, respectively, of the supporting elements for holding the formwork panels in the desired position. Clamping surfaces 12, 13 of the claws 1, 2 are adjacent underneath the tabs 5, 6, i.e. in the direction of the axis, in order to press against a corresponding contour of the supporting elements. In the final position, the tabs 5, 6 and the clamping surfaces 12, 13 are generally orientated approximately mirror-symmetrically and connect the supporting elements of two formwork panels non-positively. Thus, when producing a concrete component, the concrete thus cannot bleed out, i.e. cannot escape in the liquid state between the two formwork panels connected by the connecting device.

For the general and exemplary illustration of a formwork panel or formwork with a formwork facing and elements supporting the formwork facing and of the engagement of a tab of the connecting device into a groove of a supporting element of a formwork for connecting two formwork panels, reference may be made to the Figures of the patent applications with the file numbers 102012217823.6 and 102012214396.3.

FIGS. 1 and 2 show a connecting device which provides, between the initial position and the final position, an intermediate position which has been adapted exactly when the rounded tip 8 of the triangular projection 7 of the pivotable claw 1 has arrived in a position aligned with the contact surface 17 of the top part 16 of the housing 15 by placement against the supporting elements.

A biased torsion spring 9 is disposed wound around the rivet 4 in such a way that the pivotable claw 1 is permanently pressed in the direction of the initial position, i.e. in the direction of an open position of the claws.

A cross bore in the pivotable claw 1, which is disposed between the tab 6 on the one hand and the triangular projection 7 and the lever arm 11 on the other hand, together with the rivet 4 forms a rotary bearing for the pivotable claw 1. The rivet 4 is connected to the housing 15 in a loss-proof and positive manner by means of two opposite bores on the side walls of the U-shaped profile 18 of the housing 15.

In order to obtain a compact connecting device with a particularly small pivoting radius and small pivot arc length, the cross bore of the pivotable claw 1 is disposed in the direction-changing region 10 of the pivotable claw 1, and the pivotable claw 1 is configured in an L-shape. The direction-changing region 10 is formed in a rounded manner in order to achieve a longer life of the pivotable claw under stress.

In the exemplary embodiment of the connecting device according to the invention depicted in the FIGS. 1 and 2, pivoting of the pivotable claw 1 is caused by a translational movement 14 of the wedge 3. The direction of movement of the wedge 3 is orientated parallel to the rivets of the supporting elements in order to make a particularly small construction space of the connecting device and an easier access for a tool, such as a hammer, possible.

The translational movement 14 of the wedge 3 is guided by the housing 15. Two opposite slits 20 are placed in the side walls of the U-shaped profile 18 for guiding the wedge 3. In order to guide the wedge relative to the top part 16 of the housing 15 with a particularly low level of friction, one supporting surface 21, respectively, is provided in the top part 16, adjacent to the slits 20, which, in addition, is shaped in a cost-effective manner by means of a shaping process.

The wedge 3 is disposed between the lever arm 11 of the pivotable claw 1 and the two supporting surfaces 21, so that the insertion of the wedge 3 into the connecting device is able to cause the lever arm 11, and thus the pivotable claw 1, to pivot into the final position, due to the increase in cross section of the wedge 3 at the interface with the lever arm 11. Because the interface of the lever arm 11 and the wedge 3 is situated in the middle between the two supporting surfaces 21 and the lever arm 11 always presses the wedge 3 against the supporting surfaces 21 because of the biased torsion spring 9, troublesome tilting movements of the wedge 3 during a translational movement 14 can be avoided.

FIG. 3 shows the wedge 3 in a side view. On the side facing towards the supporting surfaces 21, the wedge 3 has a straight surface. The opposite side, i.e. the side facing towards the lever arm 11, in the side view reveals a profile with several portions (FIG. 3).

The first portion 22 of the wedge is the portion which is in engagement with the pivotable claw in the final position and which has the smallest angle of gradient 26. The second portion 23 is shorter than the first portion 22 and has a greater angle of gradient 27 as compared with the first portion 22.

The third portion 24 comprises a U-shaped recess 31 with a side wall 28 towards the second portion 23 and the opposite side wall 29 towards the fourth portion 25. The fourth portion 25 has a straight surface and leads to the end of the wedge 3.

In the region of the fourth portion 25, a cross bore 30 for attaching a rivet as a stop means is inserted in order to cause the wedge 3 to always be guided through both slits 20 of the U-shaped profile 18 and not be able to disengage from the connecting device.

Because of the profile of the wedge 3 disclosed in a side view in FIG. 3, the connecting device can be brought into the initial position by pulling the wedge 3 out of the connecting device. The initial position has been reached when the lever arm 11 enters the U-shaped recess 31.

In order to achieve a particularly reliable sliding of the lever arm 11 into the U-shaped recess 31, the side walls 28, 29 are beveled. Because of the biased torsion spring 9, the lever arm 11 is always pressed against the wedge 3 when the wedge 3 is pulled out, so that the translational movement 14 can take place in a straight manner and without any troublesome tilting movement, and the lever arm 11 in the initial position is retained in the U-shaped recess 31 and thus locked.

Thus, the wedge 3 cannot make any translational movements 14 in the initial position due to the blocking side walls 28, 29. Because the claws 1, 2 can be fixed in the initial position with a particularly large opening angle relative to one another, the connecting device can be placed on the supporting elements for assembly particularly simply and rapidly. By placing the connecting device against supporting elements, the connecting device comes into the intermediate position. In the intermediate position, the lever arm 11 is pivoted in such a way that only the side wall 29, and no longer the side wall 28, forms a barrier for a translational movement of the wedge 14.

Thus, the user can continue the insertion of the wedge 3 into the connecting device after placing the connecting device against the supporting elements of the formwork panels to be connected. First, a large pivoting distance of the pivotable claw 1 is generated, because of the large angle of gradient 27 of the second portion 23, with only a short advancing distance of the wedge 3 into the connecting device, i.e. a rapid delivery is enabled.

Then, the small angle of gradient 26 of the first portion 22 ensures that a small advancing force applied to the wedge 3 is able to effect a large contact force when the tabs 5, 6 and the clamping surfaces 12, 13 are pressed against the supporting elements. If the manual force of the user does not suffice he is free to use a hammer in order to move the connecting device into the final position.

The T-shaped profile 32 at the end of the wedge 3 ensures that the wedge 3 is able to withstand the use of the hammer. In the final position, the small angle of gradient 26 of the first portion 22 results in a particularly large self-locking action. In order to increase the self-locking action, a recess 33 for the torsion spring 9 is placed in the lever arm 11 so that the lever arm 11 can rest flush on the bottom of the U-shaped profile 18 in the final position.

In order to remove the connecting device in the context of dismantling, the T-shaped profile 32 serves as an impact surface for a hammer or a similar tool for moving the wedge 3 out of the connecting device.

The housing 15 of the exemplary embodiment shown in FIGS. 1 and 2 of the connecting device according to the invention is constructed from simple formed sheet metal part with particularly little effort. The housing 15 comprises a U-shaped profile 18, a top part 16 and a corner part 19 for stabilization and as a stop for the pivotable claw in the event of a detachment of the wedge from the connecting device.

In one embodiment, the intermediate position can also be reached by manual actuation of the pivotable claw 1. If the connecting device is arranged horizontally, the wedge 3, for example, is conveyed by gravitation into a position that makes it particularly easy to drive it in further using a hammer.

In an initial position, manually pivoting the wedge 3 away from the formwork in the direction of the user can accomplish that the pivotable claw 1 can be pivoted in such a way that the pivotable claw 1 adopts an orientation as in the intermediate position. Even in the case of such a pivoting, the wedge 3 is prevented by the blocking side walls 28, 29 from making a translational movement 14.

The two above-described functions are capable of facilitating to a particular extent the connection of two formwork panels by the connecting device.

FIG. 4 shows another exemplary embodiment of the connecting device according to the invention with the fork-shaped claws 1, 2 whose prongs are able to grasp around a crossbar. The prongs have beads 34 configured in such a way that the beads 34 are capable of both increasing the strength of the prongs or fork-shaped claws 1, 2 and enabling a particularly good transmission of forces onto the webs or side walls of the crossbars.

The invention claimed is:

1. A connecting device for formwork panels with a formwork facing and elements supporting the formwork facing for building concrete structures, the connecting device comprising two claws, and a wedge configured to move at least one of the two claws relative to the other of the two claws in such a way that the supporting elements of two formwork panels disposed next to each other or one above the other are held in their desired position when supported by the connecting device, wherein one of the two claws included in the connecting device provides a pivotable claw configured in such a way that the pivotable claw can be pivoted between an initial position and a final position, about an axis of the connecting device and that the pivotable claw of the connecting device can be pivoted to an intermediate position between the initial position and the final position, wherein an actuating means for pivoting the pivotable claw into the intermediate position is adapted to be actuated by placing the connecting device against the supporting elements, wherein the actuating means is arranged between two ends of the pivotable claw, wherein the one end is a tab of the pivotable claw adapted to enter into a groove of a supporting element in the final position, and the other end is a lever arm, wherein the pivotable claw is configured in an L-shape, wherein the axis is disposed in the direction-changing region of the L-shape, wherein the actuating means for pivoting the pivotable claw into the intermediate position is a projection extending from the pivotable claw, and wherein the projection is triangular or the projection has a rounded tip.

2. The connecting device according to claim 1, wherein the axis of the connecting device is disposed between an actuating means for pivoting the pivotable claw into the intermediate position and the tab of the pivotable claw adapted to enter into a groove of a supporting element in the final position.

3. The connecting device according to claim 1, further comprising a biased spring arranged to press the pivotable claw in the direction of the initial position.

4. The connecting device according to claim 1, wherein the wedge is mounted for translational movement and is configured such that translational movement of the wedge causes the pivotable claw to pivot, wherein the direction of movement of the wedge is orientated parallel to the axis of the connecting device.

5. The connecting device according to claim 1, wherein the lever arm configured to be pivoted by inserting the wedge into a housing, wherein the axis of the connecting device is disposed between the lever arm and the tab of the pivotable claw.

6. The connecting device according to claim 1, further comprising a housing including a slide bearing for the wedge in the form of two support surfaces.

7. The connecting device according to claim 6, wherein the housing comprises a guide for translational movement of the wedge in the form of two slits.

8. The connecting device according to claim 7, wherein the housing is made from formed sheet metal parts.

9. The connecting device according to claim 1, wherein the wedge has at least two portions with different angles of gradient, a first portion of the wedge with a smallest angle of gradient of the at least two portions is disposed in such a way that the first portion, in the final position, is in engagement with the pivotable claw.

10. The connecting device according to claim 9, wherein an angle of gradient of the first portion is greater than 2°.

11. The connecting device according to claim 10, wherein the angle of gradient of the first portion is less than 10°.

12. The connecting device according to claim 9, wherein an angle gradient of a second portion of the wedge is greater than 15°.

13. The connecting device of claim 12, wherein the angle gradient of the second portion of the wedge is less than 60°.

14. The connecting device according to claim 1, wherein the wedge is formed to include a recess arranged to lock the wedge when in the initial position of the connecting device.

15. The connecting device according to claim 1, wherein the projection has a rounded tip with a radius of 4 mm to 6 mm.

16. A connecting device adapted for use with formwork boards in a system, the connecting device comprising two claws, a wedge configured to move at least one of the two claws relative to the other of the two claws, and a projection extending from the at least one of the two claws and arranged between two ends of the at least one of the two claws adapted to be actuated when the connecting device is placed against two formwork panels, wherein the one end is a tab of the pivotable claw adapted to enter into a groove of a supporting element in the final position, and the other end is a lever arm, wherein the at least one of the two claws is configured in an L-shape, wherein a pivot axis of the at least one of the two claws is disposed in the direction-changing region of the L-shape, and wherein the projection is arranged between the supporting element and pivot axis in the final position.

17. The connecting device according to claim 1, wherein the projection is triangular and has a leg angle of 30° to 40.

* * * * *